United States Patent [19]

Davenport et al.

[11] Patent Number: 4,810,135

[45] Date of Patent: Mar. 7, 1989

[54] COMPLIANT OFFSHORE STRUCTURE WITH FIXED BASE

[75] Inventors: George F. Davenport; Lyle D. Finn, both of Houston, Tex.; Jerome Q. Burns, San Diego, Calif.

[73] Assignee: Exxon Production Research Company, Houston, Tex.

[21] Appl. No.: 58,020

[22] Filed: Jun. 4, 1987

[51] Int. Cl.[4] ..... E02B 17/00

[52] U.S. Cl. ..... 405/224; 405/202; 405/204

[58] Field of Search ..... 405/195, 202, 222, 223, 405/224, 225, 226, 227, 204

[56] References Cited

U.S. PATENT DOCUMENTS

| | | | |
|---|---|---|---|
| Re. 32,119 | 4/1986 | Abbott et al. | 405/227 |
| 3,636,716 | 1/1972 | Castellanos | 405/202 |
| 3,670,515 | 6/1972 | Lloyd | 405/202 |
| 4,284,367 | 8/1981 | Tuson et al. | 405/202 |
| 4,482,274 | 11/1984 | Brandi et al. | 405/224 |
| 4,696,601 | 9/1987 | Davenport | 405/202 |
| 4,696,603 | 9/1987 | Danaczko et al. | 405/227 |

FOREIGN PATENT DOCUMENTS

| | | |
|---|---|---|
| 2070112A | 9/1981 | United Kingdom . |
| 2066336B | 11/1983 | United Kingdom . |

OTHER PUBLICATIONS

"Exxon Study Shows Compliant Piled Tower Cost Benefits", by Maus et al., Ocean Industry, Mar. 1986, pp. 20–25.

"Norwegian North Sea Compliant Tower", informal undated report authored by Hasle, Erik of Aker Engineering A/S.

*Primary Examiner*—David H. Corbin

*Attorney, Agent, or Firm*—Richard F. Phillips

[57] ABSTRACT

A compliant offshore structure in which the primary restoring force to lateral displacement is provided by elongate flex elements. A gravity base is rigidly secured to the ocean bottom. A tower extends vertically upward from the base to a position above the ocean surface. A work deck is supported atop the tower. The tower is secured to the base by elongate flex elements which are arranged in an array surrounding the central axis of the structure. Each flex element has one end secured to the base and a second end secured to the tower. The flex elements permit the tower to pivot about its lower end, thus providing the tower and deck with a compliant response to environmental forces. The flex elements also support the tower above and free from contact with the base. This eliminates the need for a vertical load bearing joint between the tower and base.

20 Claims, 7 Drawing Sheets

FIG. 4
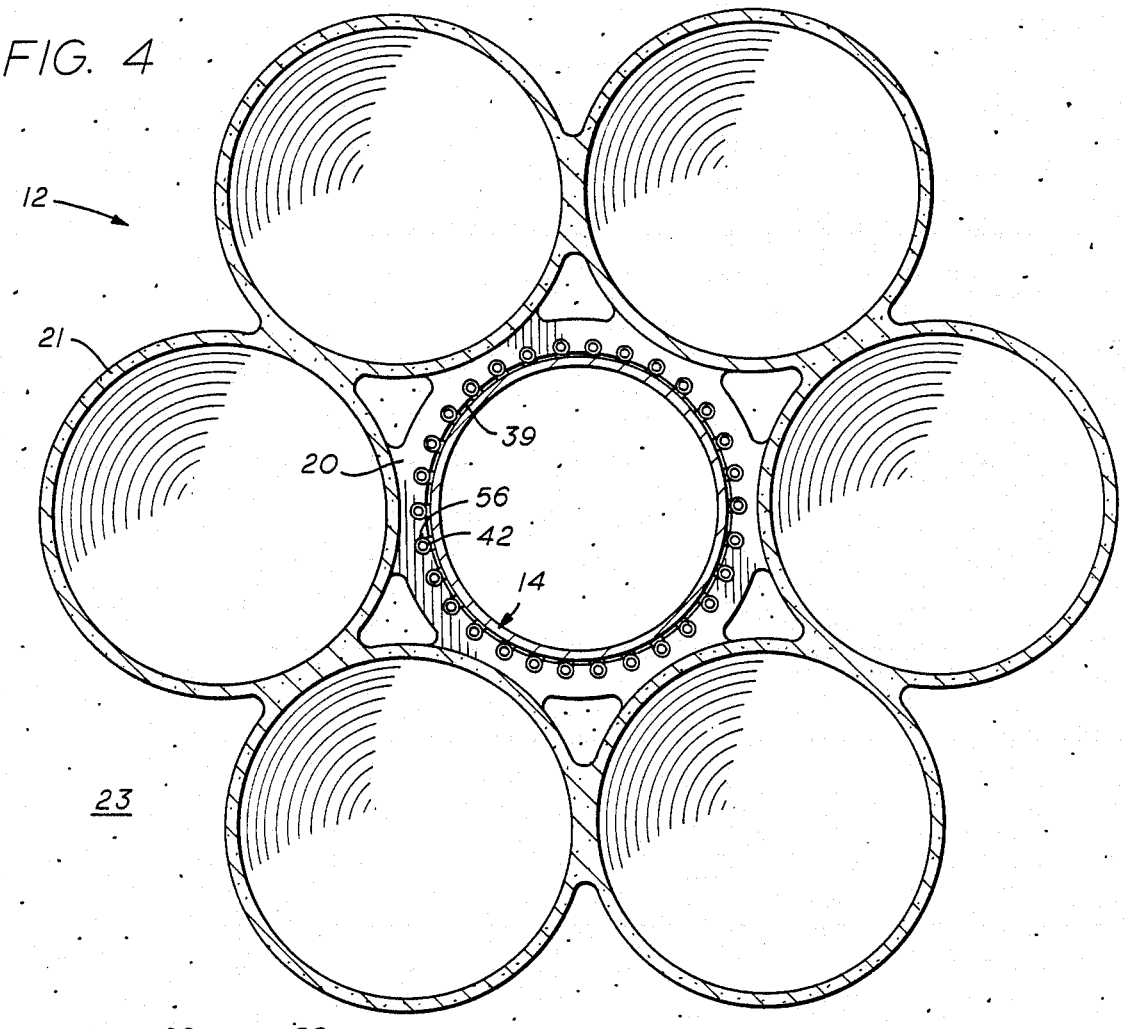
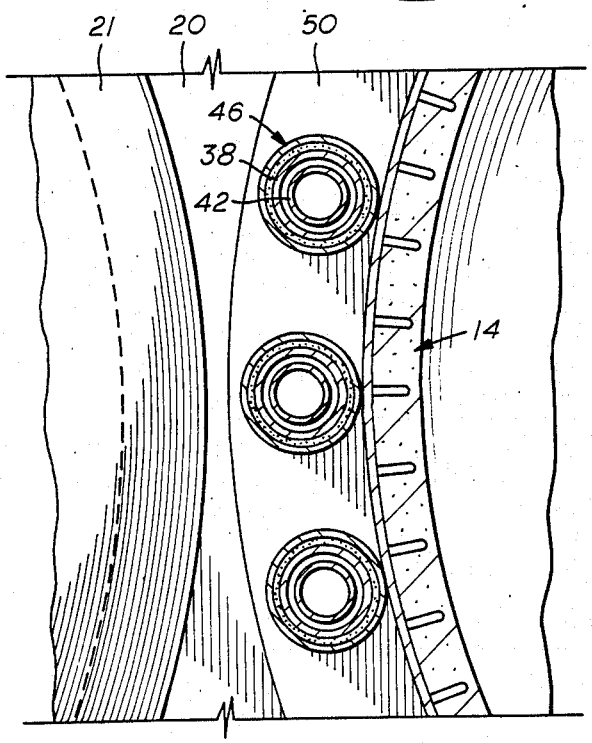
FIG. 5
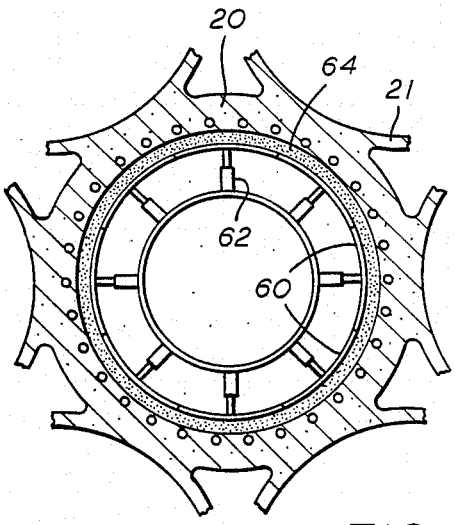
FIG. 6

COMPLIANT OFFSHORE STRUCTURE WITH FIXED BASE

The present invention relates generally to offshore structures adapted to have a compliant response to waves and other lateral loadings. More specifically, the present invention concerns an offshore structure having a tower compliantly supported above a fixed base.

BACKGROUND OF THE INVENTION

Most offshore oil and gas production is conducted from structures (commonly termed "platforms") supported on the ocean floor and extending upward to a work deck situated above the ocean surface. A key constraint in the design of such platforms is that dynamic amplification of the platform's response to waves must be avoided. Failure to substantially avoid dynamic amplification will result in a reduction of the fatigue life of the platform and in extreme cases can result in failure of key structural platform components. Dynamic amplification of the platform's wave response is avoided by designing the platform such that each of its natural vibrational periods fall outside that range of wave periods representing waves of significant energy. For most offshore locations the range of natural vibrational periods to be avoided is from 7 to 25 seconds, this representing the range of wave periods occurring with the greatest frequency. The several modes of platform vibration which are generally of greatest concern in platform design are pivoting (commonly termed "sway") of the structure, bending of the structure along its height, and torsion about the structures's vertical axis.

For water depths up to about 300 meters, the technology for avoiding dynmic amplification of an offshore structure's wave response is well developed. Nearly all existing offshore structures used in such water depths are rigidly secured to the ocean bottom and stiffened to cause the various natural vibrational periods of the structure to be less than about 7 seconds. Such offshore structures are referred to as "rigid structures." The most common rigid structure used in offshore oil production is a tubular steel space-frame secured to the ocean floor by piles. An alternate rigid structure, employed most extensively in the North Sea, is the concrete gravity structure. Concrete gravity structures include a caisson type base which rests on the ocean floor. One or more towers are rigidly secured to the base and extend upward to a work deck above the ocean surface. Foundation skirts extend downward from the base to transmit lateral environment loads into the ocean floor. The caisson and skirts act under the submerged weight of the structure to establish a gravity foundation rigidly supporting the tower on the ocean floor.

As water depths exceed 300 meters, the volume of structural material required to maintain sufficient platform stiffness to retain the natural vibrational periods of a rigid structure below 7 seconds increases rapidly with depth. As a result, the cost of rigid structures becomes increasingly depth sensitive in water depths beyond 300 meters. It has been suggested that for even the richest offshore oil fields the use of a rigid structure could not be economically justified in water depths exceeding about 400 meters due to the constraint imposed by the maximum permissible natural vibrational period.

For deep water applications, it has been proposed to depart from conventional rigid structure design and develop platforms having a fundamental period greater than the range of periods of ocean waves containing significant energy. Such platforms, termed "compliant structures," do not rigidly resist waves and other lateral loadings, but instead compliantly resist these loadings primarily by their own inertia, undergoing significant lateral motion at the ocean surface. This is typically achieved either by allowing the structure to pivot about its base or by allowing the structure to bend over its length. It is normally impractical to render the periods of second and higher modes compliant; this requires that these periods be kept below about 7 seconds to prevent dynamic amplification. Thus, compliant structures are characterized by the fact that the range of ocean-wave periods containing significant energy is straddled by the fundamental period on the high side (above about 25 seconds), and by all remaining periods on the low side (below about 7 seconds). The use of a compliant offshore structure effectively removes the upper bound on the fundamental period, thus avoiding the most troublesome design contraint of rigid structures. This greatly reduces the increase in the volume of structural material, and hence cost, required for a given increase in water depth.

Compliant structures must be provided with some mechanism for countering lateral displacement resulting from the action of wind, waves and ocean currents. Countering such lateral displacement is termed "stabilization." Stabilization is accomplished in existing compliant offshore structures in a variety of manners. In one class of compliant offshore structures, including tension leg platforms and buoyant towers, stabilization is provided by buoyancy. Such structures include a buoyant portion typically located at or near the ocean surface. As environmental forces displace the platform laterally, the buoyant force acting on the buoyant portion establishes a righting moment which acts to restore the structure to a vertical orientation. A significant disadvantage of buoyant structures is that the large buoyancy chambers they require greatly increase the expense of the structure. These buoyancy chambers also increase the cross-sectional area of the structure exposed to waves and ocean currents. This results in increased lateral loading, requiring a stronger structure than would otherwise be necessary. A typical tension leg platform is shown in U.S. Pat. No. 4,428,702, issued Jan. 31, 1984. A typical buoyant tower is shown in U.K. Pat. No. 2,066,336B, issued Nov. 2, 1983.

In a second type of compliant structure, the guyed tower, the platform deck is supported on a slender space-frame structure extending from the ocean bottom to the ocean surface. A plurality of catenary guylines extend radially outward from an upper portion of the tower to the ocean bottom. The guylines provide the necessary stabilization. A major disadvantage of guyed towers is that the guyline system is expensive to fabricate, deploy and maintain. In certain applications the guylines also present an obstacle to navigation and fishing in the vicinity of the platform. A typical guyed tower is detailed in U.S. Patent No. Re. 32,119, issued Apr. 22, 1986.

A third type of compliant structure, known as the compliant piled tower, uses flex piles to provide stability. The compliant piled tower is a rigid tower structure having piles driven into the ocean floor and extending upward along the tower to a preselected elevation where the piles are secured to the tower. The tower is laterally supported at its lower end by the flex piles, but is permitted to slide vertically along the flex piles, permitting the structure to rotate about its lower end. In response to pivoting of the tower away from the vertical, the piles establish a righting moment (couple) acting where the piles are secured to the tower. This provides the stabilization necessary to restore the tower to a vertical orientation. A disadvantage of the compliant piled tower is that design and installation are complicated by conflicting demands placed on the flex piles, which must be flexible enough to achieve compliant behavior, yet stiff enough to withstand pile-driving stresses during installation. Another disadvantage of the compliant piled tower is that a portion of each flex pile must be driven after the tower is in place. This is expensive and extends the duration of the installation window when the structure is vulnerable to damage by storms. One form of compliant piled tower is detailed in U.S. patent application Ser. No. 806,055, filed Dec. 5, 1985.

It would be desirable to develop a compliant offshore platform that avoids the need for a mechanical pivot joint, that does not rely on positive buoyancy, guylines or fixed piles to counter lateral environmental loadings, and that can be fully constructed and assembled inshore.

SUMMARY OF THE INVENTION

The present invention is directed to a compliant offshore structure having a fixed base resting on the ocean bottom and a tower supported above the base by elongate flex elements. A deck is secured to the upper end of the tower. The flex elements are preferably arranged in one or more concentric rings around the tower. One end of each flex element is anchored to the base and the other end is secured to the tower. In the preferred embodiment, the tower and deck have a net negative buoyancy. This maintains the flex elements under a compressive loading. As the platform tilts in response to waves and other lateral loadings, the flex elements toward the direction of tilt are placed in increased compression and the flex elements away from the direction of tilt are placed in reduced compression. This results in the application of a restoring couple to the tower which stabilizes the tower and deck against excessive displacement. The stiffness, number and location of the flex elements are selected to yield a tower away period greater than about 25 seconds.

Numerous advantages are provided by the manner in which compliancy and tower stabilization are achieved in the present invention. In the preferred embodiment, the flex elements support the entire weight carried by the tower and also restrain the base of the tower from lateral and torsional movement. This eleminates the need for a mechanical pivot joint for transmitting vertical loads between the tower and base. This is a great advantage because meachnical joints in compliant offshore structures present maintenance problems and significantly increase fabrication expenses. Also, the present structure can be fabricated to near completion, including the installation of the flex elements, in a protected marine location, such as a fjord. Installation of the structure is relatively quick because there is no need for onsite installation of tethers, guylines or piles as is required for other types of compliant offshore structures.

BRIEF DESCRIPTION OF THE DRAWINGS

For a better understanding of the present invention, reference may be had to the accompanying drawings, in which:

FIG. 4 is a horizontal cross section of the base taken through line 4—4 of FIG. 2;

FIG. 5 is a detail taken along line 5—5 of FIG. 2;

FIG. 6 is a horizontal cross section of the base-tower interface taken as it appears during fabrication;

These drawings are not intended as a definition of the present invention, but are provided solely for the purpose of illustrating certain preferred embodiments of the invention, as described below.

DESCRIPTION OF THE PREFERRED EMBODIMENTS

Introduction

Figure 1:
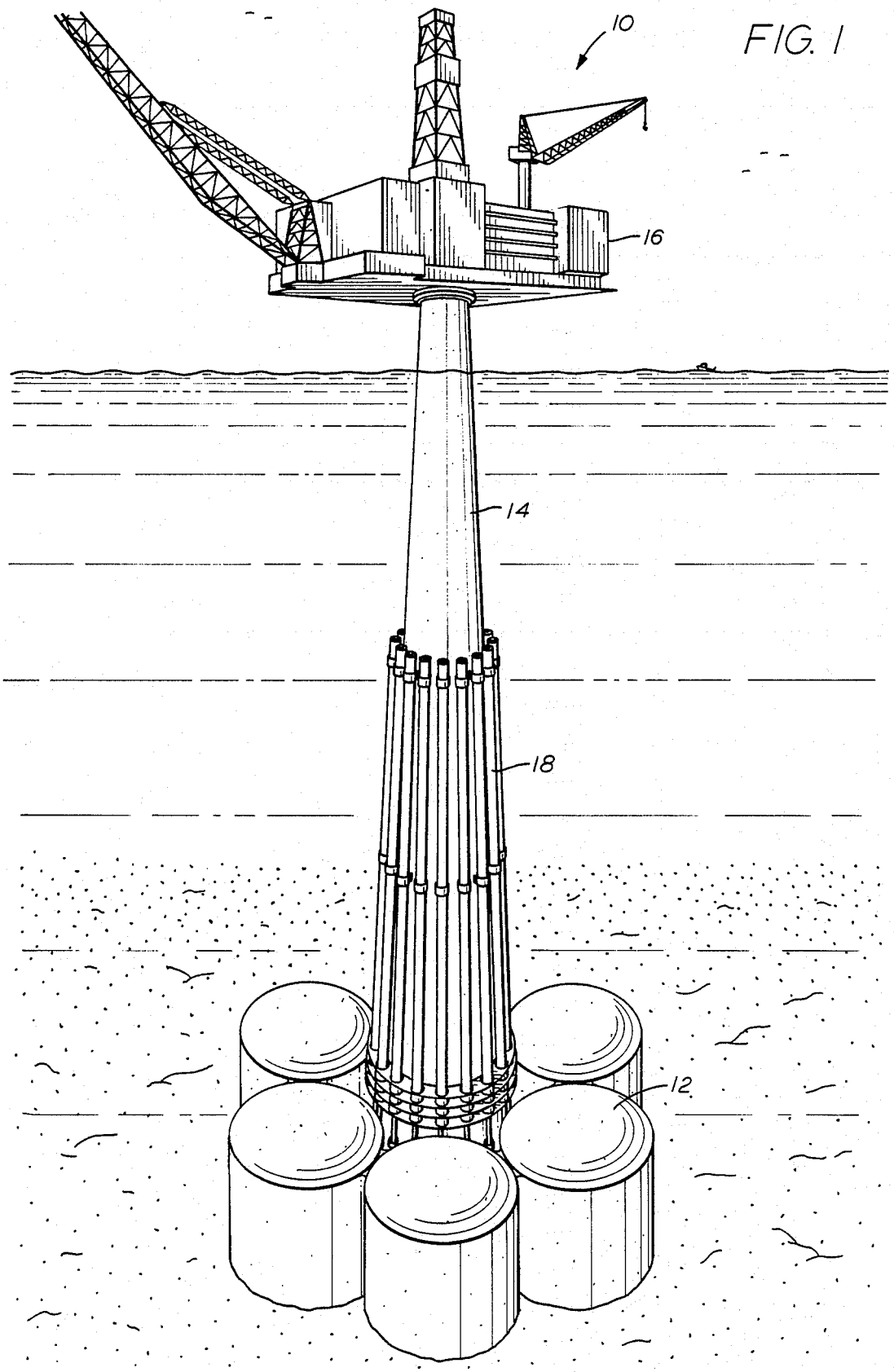
FIG. 1 is a perspective view of the preferred embodiment of the compliant offshore structure of the present invention.

FIG. 1 shows an elevational perspective view of a compliant offshore structure which represents a preferred embodiment of the present invention. As will become apparent in view of the following description, the preferred embodiment takes the form of a concrete tower adapted for use as an oil and gas drilling and production platform in water depths exceeding 300 meters. However, the present invention can assume many other embodiments and can be used for a variety of other purposes. To the extent that the following description is specific to a particular embodiment and use of the present invention, this is by way of illustration rather than limitation.

As shown in FIG. 1, the compliant offshore structure 10 of the present invention includes four principal components: a gravity base 12; a tower 14 extending upward from the base 12 to a position above the ocean surface; a work deck 16 supported atop the tower 14; and a set of flex elements 18 anchored between the base 12 and tower 14. As the tower 14 sways from the vertical in response to waves, wind and ocean currents, the flex elements 18 attached to that side of the tower 14 toward the direction of tilt are compressed and the flex elements 18 on the opposite side of the tower 14 are extended. This establishes a restoring couple acting at the point at which the flex elements 18 are secured to the tower 14, biasing the tower 14 back to a vertical orientation. The flex elements 18 serve a second function of transferring the entire submerged weight of the tower 14 and deck 16 to the base 12. This avoids the need for a vertical load bearing machanical joint between the tower 14 and base 12. In the preferred embodiment that flex elements 18 also serve a third function of restraining the bottom end of the tower 14 from lateral and torsional motion. This eliminates the need for a mechanical joint between the tower 14 and base 12 to provide shear restraint to the lower end of the tower 14. The entire structure 10 can be fabricated in protected waters and towed to the installation site. The use of a gravity base 12 as an anchorage for the flex elements 18 greatly simplifies installation, avoiding the lengthy pile-driving operations necessary in installing compliant piled towers.

Configuration of the Preferred Embodiment

Figure 2:
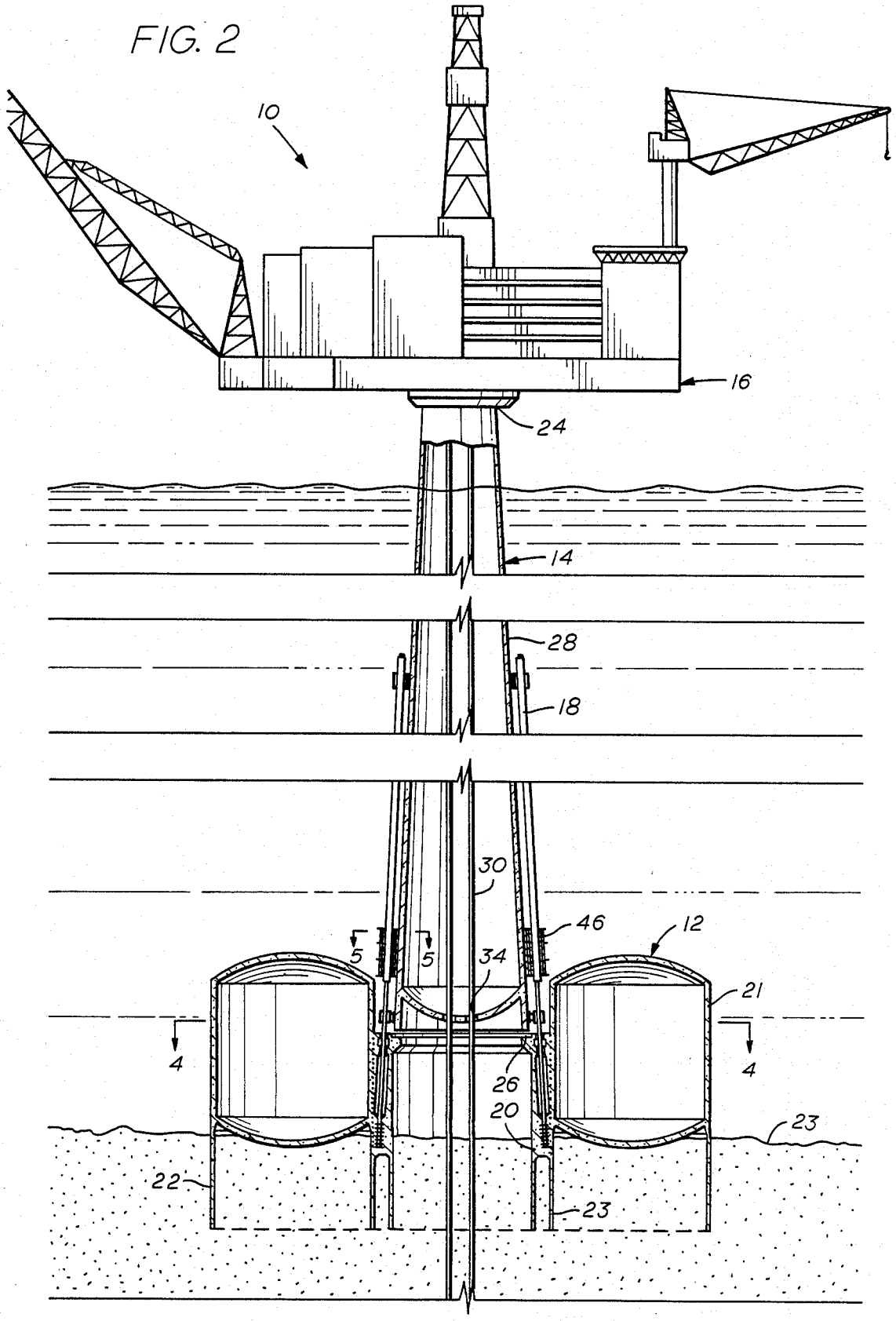
FIG. 2 is an elevational cut-away view corresponding to FIG. 1, illustrating details of the arrangement for compliantly supporting the tower atop the gravity base.

Referring now to FIG. 2, the compliant offshore structure 10 will be described in greater detail. The base 12 is a substantially conventional concrete gravity structure having seven cells 20, 21 provided with skirts 22 which extend downward from the cells 20, 21 into competent soils beneath the ocean floor. The central cell 20 is an open-ended right circular cylinder. The six outer cells 21 are closed right circular cylinders arranged around the central cell 20. These six outer cells 21 are used as flotation and ballast caissons during construction and installation of the structure 10 and may also be used for hydrocarbon storage during operation of the structure 10. In installation of the compliant offshore structure 10, the gravity base 12 is rigidly secured to the ocean bottom 23 to establish a stable foundation from which the tower 14 may be supported and stabilized by the flex elements 18.

The tower 14 is a substantially conventional reinforced, prestressed concrete shell structure taking the form of a conical frustum. The tower 14 includes an upper end portion 24 supporting the deck 16, a lower end portion 26 which, as more fully detailed below, is maintained substantially free from vertical load bearing contact with the central cell 20, and a load-bearing wall portion 28 extending between the upper and lower end portions 24, 26. The lower end portion 26 preferably includes a convex concrete shell which serves to seal the bottom of the tower 14 against seawater entry during construction and installation of the structure 10. Drilling and production are performed through conductors 30 extending downward from the deck 16 into the ocean floor 23 through the tower 14. The lower end portion 26 is provided with several apertures 34 covered by removable plates through which the drilling and production conductors 30 are lowered following installation of the structure 10. Those skilled in the art will recognize that the tower 14 could be a space-frame structure instead of a single concrete tower and could be made of materials other than concrete.

Figure 3:
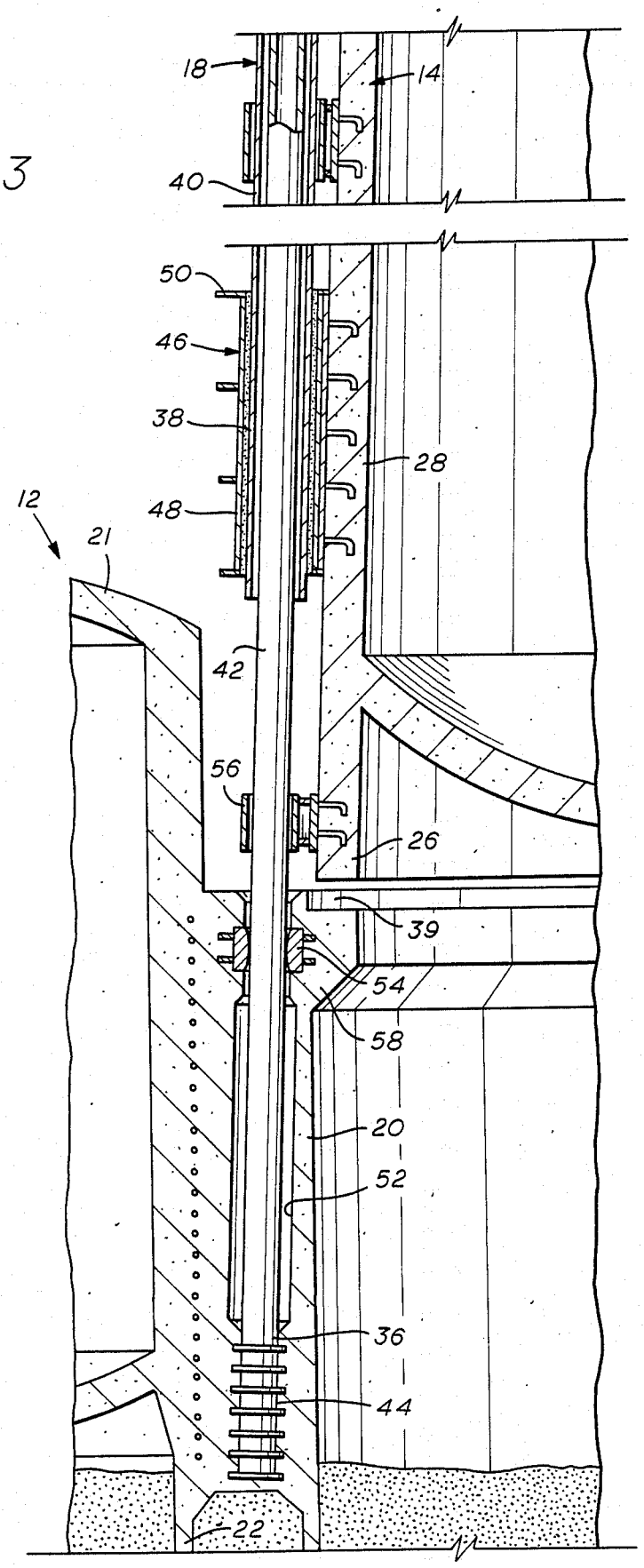
FIG. 3 is a detial corresponding to FIG. 2 of the interface between the base and the tower.

FIG. 3 is a detailed cross-section illustrating the preferred configuration of the flex elements 18 and the manner in which they are connected between the base 12 and tower 14. The flex elements 18 are each oriented generally parallel to the surface of the tower 14 and are arranged in an array surrounding the central axis of the tower 14, as best shown in FIG. 4. In principle, the flex elements 18 are elongate members having a first end 36 secured to the base 12 and a second end 38 secured to the tower 14. The flex elements 18 are adapted to undergo limited elasatic strain under axial loading. As will be more fully discussed below, the changes in the length of each flex element 18 resulting from this strain resistively accommodate sway of the tower 14 about the base 12. In the preferred embodiment, the flex elements 18 are made up exclusively of steel tubular members of a length sufficient to elastically accommodate the necessary elongation. Alternately, the flex elements 18 could be shorter steel elements incorporating mechanical or elastomeric spring units to provide the necessary degree of axial flexibility. This would significantly reduce the required length of the flex elements 18. U.S. patent application No. 929,539, filed Nov. 10, 1986, discloses a steel tubular element with an elastomeric spring suitable for this purpose.

The flex elements 18 are each under substantially equal axial compressive loadings when the tower 14 is vertical. As the tower 14 tilts, the flex elements 18 toward which the tower 14 is tilting are further compressed and the flex elements 18 on the opposite side of the tower 14 are extended. The resulting flex element load imbalance results in the application of a restoring couple which stabilizes the tower 14 against excessive sway. In the preferred embodiment, the flex elements 18 support the tower lower end 26 a spaced distance above the underlying portion of the central cell 20. This spacing provides a gap 30 sized to prevent contact between the base 12 and tower 14 under all tower sway conditions. The configuration, location and number of the flex element 18 is selected to provide the tower 14 and deck 16 assembly with a compliant response to waves and other lateral loadings. The preferred natural vibrational period should exceed about 25 seconds. Angular displacement of the tower 14 under a maximum design loading event would be about 2° for a 300 meter tower and about 1° for a 600 meter tower.

In the preferred embodiment of the present invention, the tower 14 and deck 16 together have a net negative buoyancy. Though buoyancy is not necessary to the stabilization of the structure 10, in some embodiments it may be desirable to provide supplemental buoyancy near the upper portion of the tower 14 for the purpose of offsetting some portion of the deckload or tuning the fundamental period of the structure 10.

The flex elements 18 preferably take the form of nested tubular steel elements. In the embodiment shown in FIG. 3, the nested flex elements 18 have two major components, an outer tubular member 40 and an inner tubular member 42 extending through the outer tubular member 40. The lower end 36 of the inner tubular member 42 is secured to an anchorage 44 in the base central cell 20. The upper ends of the outer and inner tubular members 40, 42 are secured together. The lower end 38 of the outer tubular member 40 is secured to a tower anchorage 46. The length changes imposed on the nested flex elements 18 as the tower tilts away from the vertical are accomodated by the combined length of the inner and outer tubular members 40, 42. Thus, a two component, nested flex element can accept twice the elongation or compression of a single component flex element of the same actual height and material.

Though the preferred embodiment of the present invention utilizes a two component nested flex element, it will be appreciated that other flex element configurations are also possible. A nested flex element having three or more nested tubulars could be used. In deep water it may be possible to use single component flex elements with the tower anchorage 46 being situated at a location on the tower 14 a spaced distance above the base 12. However, in most applications it will be necessary to use nested flex elements because the elongation imposed on the flex elements 18 during maximum tower sway cannot be safely accomodated by a single steel member even were it to extend the full height of the structure 10 to an anchorage at the deck 16.

As best shown in FIG. 3, the tower anchorage 46 for the flex elements 18 is an annularly arranged set of sleeves 48 secured to the tower wall 28 a distance above the base 12. The sleeves 48 extend through a series of circumferential steel rings 50 which provide lateral support to the sleeves 48. The tower connection end 38 of each flex element 18 is secured within a corresponding one of the sleeves 48 by grouting, welding or other means. The base anchorage 44 for the flex elements 18 is achieved by casting the base connection end 36 of each flex element 18 into the annular side wall of the base central cell 20.

One of the problems faced in the preferred embodiment of the structure 10 is that the flex elements 18 must be flexible enough to accommodate the bending to which they are subjected in tower pivoting, yet have sufficient shear resistance to restrain the lower end of the tower 14 from torsion and lateral displacement. These competing requirements are accommodated by spacing the two shear load transfer points 54, 56 for each flex element 18 closer to one another than the axial distance between the two anchorages 44, 46. The base anchorage 44 is positioned at the bottom of the sidewall of the central cell 20. A cylindrical aperture 52 extends upward through the sidewall above the anchorage 44 for each flex element 18. These apertures 52 have a diameter substantially greater than that of the base connection end 36 of the flex elements 18. A flex element base guide 54 is positioned near the top of each aperture 52 to restrain the corresponding portion of the flex element 18 from lateral displacement relative to the base 12. The tower anchorage 46 is situated a distance above the tower lower end 26 and a flex element guide 56 is situated on the tower 14 a short distance above the base 12. This arrangement permits shear loads to be transferred from the tower 14 to the base 12 at points spaced just a few meters apart on the flex elements 18 while allowing the lower end of each flex element 18 to flex over the considerably greater distance between the base and tower anchorages 44, 46. This minimizes torsion and lateral displacement of the tower lower end 26 while providing the flex elements 18 with sufficient freedom of flexure to avoid overstraining them during maximum sway events.

Construction and Installation

Figure 7:
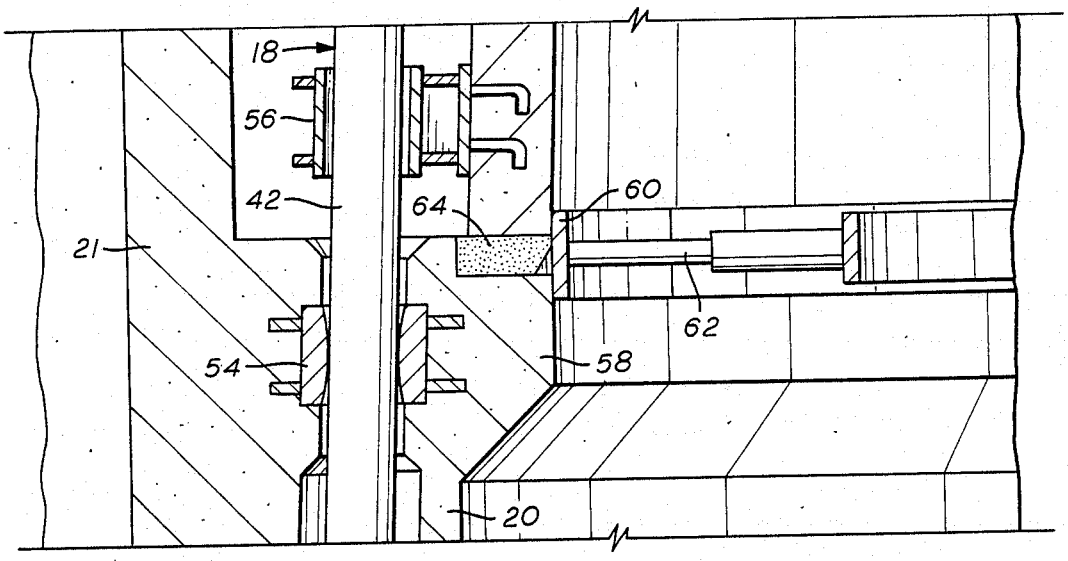
FIG. 7 is an elevational cross section of the base-tower interface as it appears during fabrication.

Construction of the compliant offshore structure 10 is largely conventional, utilizing well known concrete slipforming techniques. A special procedure is required, however, for establishing the clearance gap 39 between the base 12 and the tower 14. In the preferred embodiment, this is accomplished as follows. The base 12 is slipformed in a graving dock. A corbel 58 is cast into the inner surface of the central cell 20 at a location a short distance from the top of the central cell 20. This corbel 58 serves as a construction support surface for the tower 14. After completion of the central cell 20, a temporary steel retaining ring 60 (see FIGS. 6 and 7) is positioned to extend upward from the radially inner face of the corbel 58. The retaining ring 60 is held in place by a spider 62 radiating from the center of the central cell 20. The annular region above the corbel 58 is then filled with sand 64. The tower 14 is cast directly atop the sand layer 64 with the weight of the tower 14 being transmitted directly into the central cell 20 through the sand 64. After the flex elements 18 are complete and secured to the base and tower anchorages 44, 46, the spider 62 and retaining ring 60 are removed and the sand 64 is washed from between the base 12 and tower 14. This transfers the weight of the tower 14 to the flex elements 18. During those stages of tower construction which preceed completion of the flex elements 18, it may be necessary to temporarily stabilize the tower 14 from swaying on the sand base 64. This can be accomplished by locking the inner and outer flex element tubulars 40, 42 together through use of packers or other means.

Those skilled in the art will appreciate that alternate techniques can be used to establish the necessary clearance gap 39 between the lower end of the tower 14 and the base 12. For example, the tower 14 could be built on a temporary annular steel framework (not shown) supported on the corbel 58. After the flex elements 18 are complete, this framework would be cut away.

Installation of the compliant offshore structure 10 is accomplished with substantially the same procedures as are used for rigid caisson-type gravity structures. This is a great advantage relative to other types of nonbuoyant compliant structures developed to date, which typically require a time-consuming pile, guyline or tether installation procedure at the installation site to render them compliant. The flex element compliancy system of the present invention is fully installed and operational upon completion of fabrication at the shore-based construction site.

Alternate Embodiments

Figure 8:
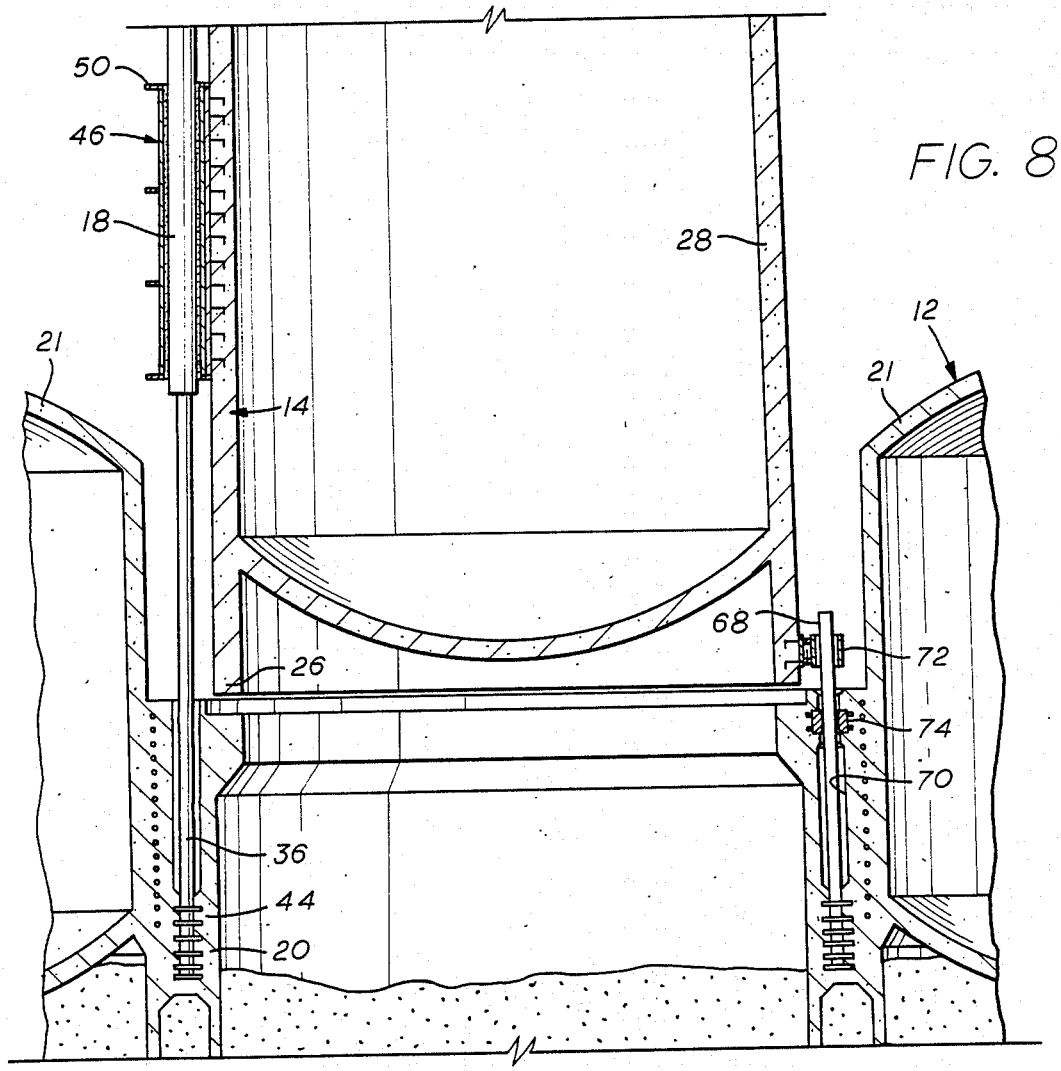
FIG. 8 is an elevational cross-section of the base-tower interface of an alternate embodiment of the present invention.

In some applications, particularly where the structure 10 is to be used in water depths of less than about 400 meters, it may impractical to use the flex elements 18 to transfer the full shear loadings necessary to restrain lateral and torsional motion of the tower 14. FIG. 8 illustrates an alternate configuraton for securing the tower 14 to the base 12 in which this problem is solved through the use of discrete shear elements 68 separate from the flex elements 18. In this embodiment, the flex elements 18 and the flex element anchorages 44, 46 are unchanged from the previous embodiment save that the base guide 54 and lower tower guide 56 for the flex elements 18 may be entirely removed or provided with an enlarged inner diameter to increase the freedom of flexure permitted to the base connection end of each flex element 18. The shear elements 68 take the form of tubular steel pins which are anchored at the bottom of the central cell 20 and extend upward through apertures 70 in the base 12 to a position a spaced distance above the tower lower end 26. The upper end of each shear element 68 extends through a sleeve 72 secured to the tower wall 28 a short distance above the base 12. A guide 74 is situated near the top of each shear element aperture 70 to accept horizontal shear loads from the tower 14 while permitting the shear element 68 to undergo the limited flexure necessary to accommodate tower pivoting without overstressing the shear element 68.

Figure 10:
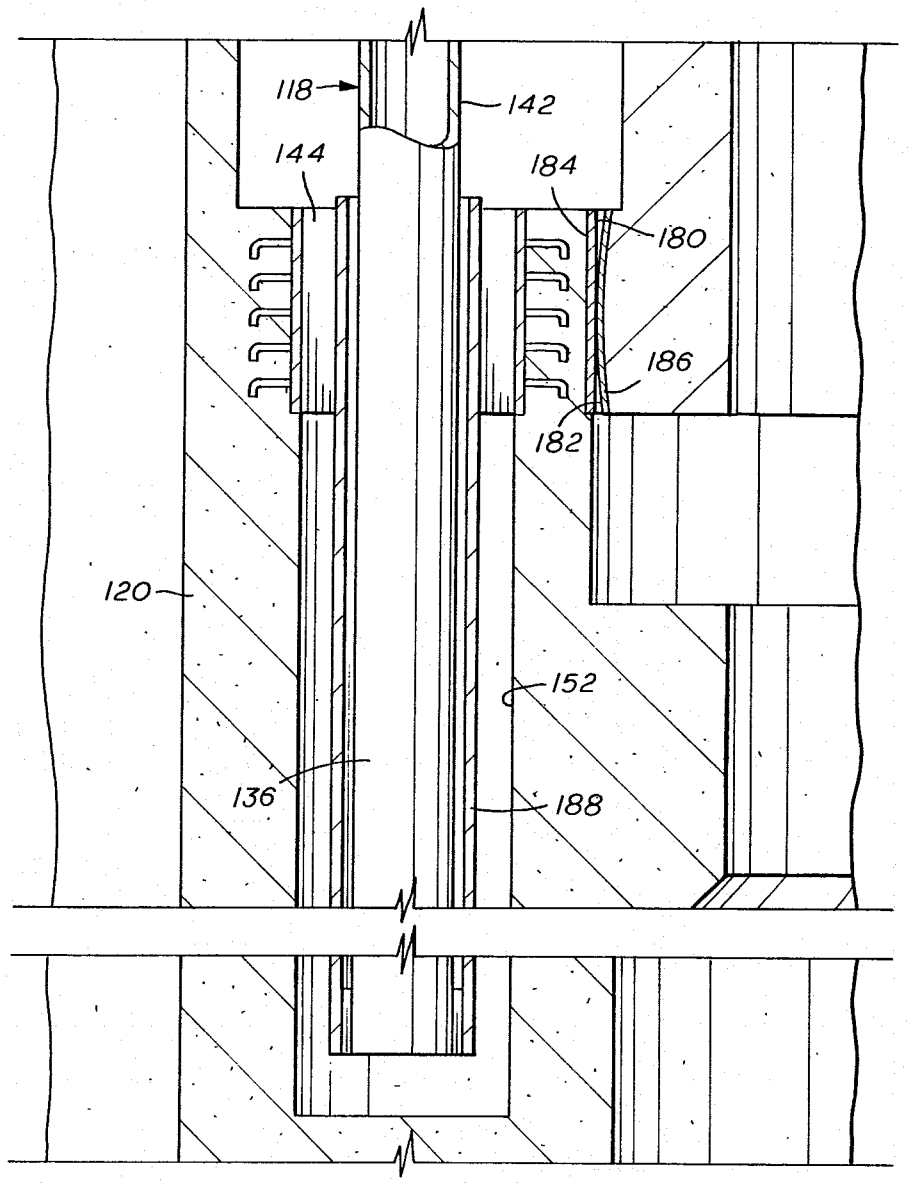
FIG. 10 is a detail corresponding to FIG. 9.
Figure 9:
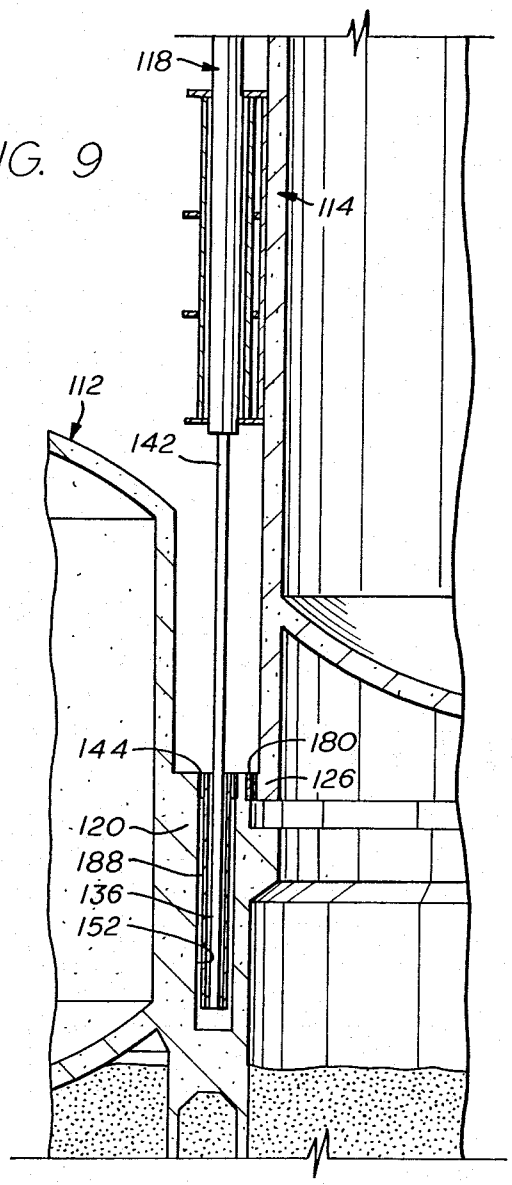
FIG. 9 is an elevational cross-section of the base-tower interface of a second alternate embodiment of the present invention.

FIGS. 9 and 10 illustrate an embodiment of the present invention in which shear loads are transferred directly from the tower 114 into the base 112. In this embodiment, the tower lower end 126 extends a few meters downward into the central cell 120. The contact surfaces 180, 182 on the base 112 and tower 114 are dimensioned to provide minimal lateral clearance between the outer surface of the tower 14 and the inner face of the central cell 120, thus preventing lateral motion of the tower lower end 126. To better accommodate tower pivoting, the tower contact surface 182 could be convex with a radius approximately equal to the radius of the tower lower end 26. The base contact surface 180 should be substantially vertical and straight in elevation. The contact surfaces 180, 182 need not be continuous around the tower lower end 126, but can be segmented and lined with replaceable metal wear pads 184, 186. If necessary, the tower contact surface 182 can interlock with the base contact surface 180 in the horizontal plane to transmit torsional loads from the tower 114 to the base 112.

FIGS. 9 and 10 also illustrate an alternate arrangement for the flex pile base anchorage 144. A cylindrical aperture 152 is provided in the sidewall of the central cell 120 for each flex element 118. The flex element base connection end 136 is nested, being provided with an additional tubular member 188 extending concentrically around the flex element inner tubular member 142. The upper end of the additional tubular member 188 is anchored to the central cell 120 at the upper end of the cylindrical aperture 152 and the lower end of the additional tubular member 188 is secured to the lower end of the inner tubular member 142. This arrangement doubles the effective free length of the flex element 118 within the central cell 120, thus permitting the flex element 118 to better accommodate the bending loads imposed during tower sway. Additionally, because the flex element 118 will normally be under a downward loading, positioning the base anchorage 144 near the top rather than the bottom of the central cell 120 provides improved load distribution through the concrete load bearing walls of the central cell 120.

Figure 11:
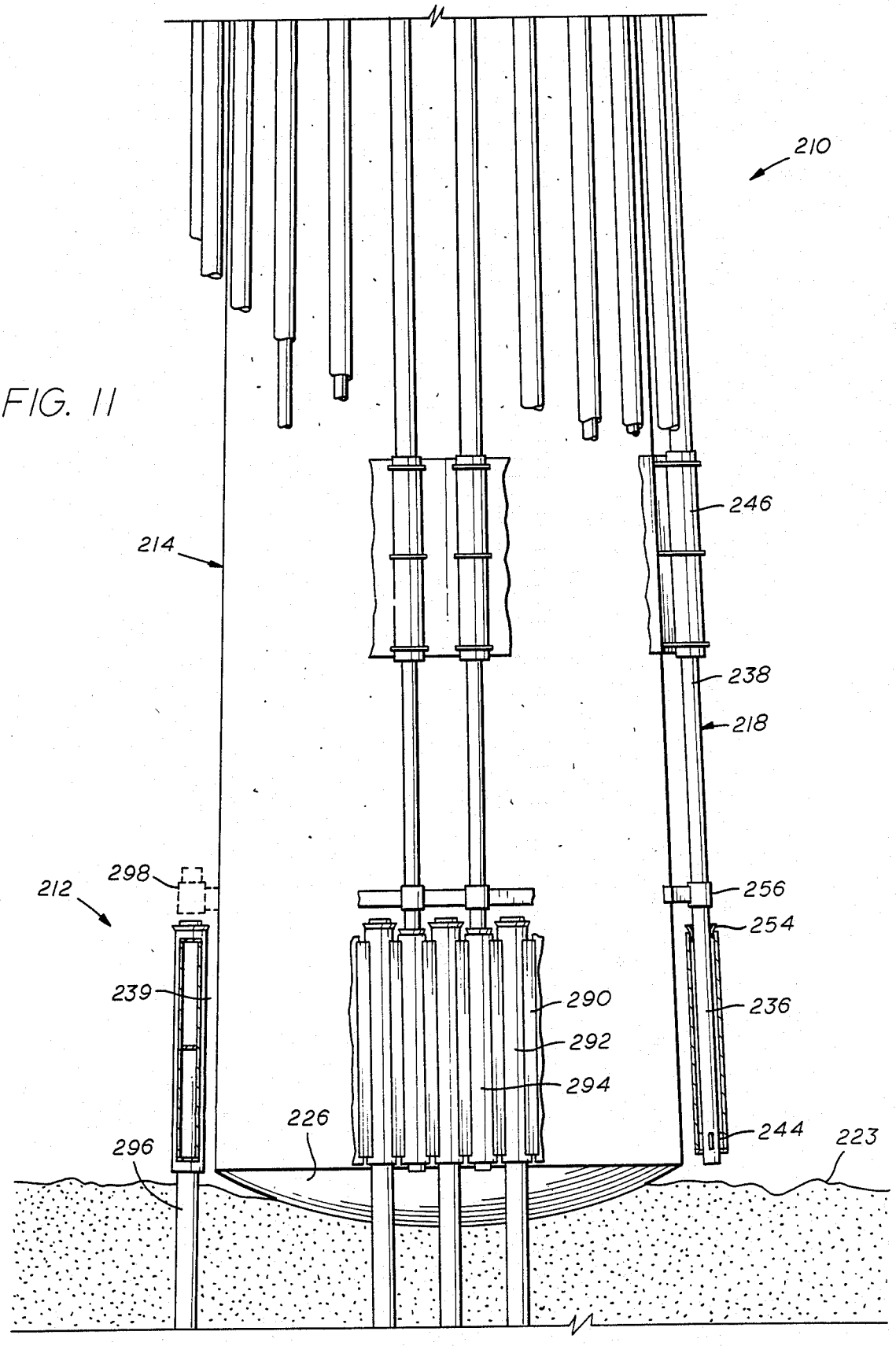
FIG. 11 is an elevational view, partially in cross-section of the base-tower interface of a third alternate embodiment of the present invention.

FIG. 11 illustrates an alternate embodiment of the present invention in which a piled base is used in place of a gravity base. It will be appreciated that aside from the nature of the base, this embodiment is very similar in structure and function to the preferred gravity base embodiment of the present invention, as described above and illustrated in FIGS. 1–5. The piled base 212 is made up of a rigid steel ring-wall 290 securing a number of pile sleeves 292 and flex element sleeves 294 in an array extending circumferentially around the tower lower end 226. A radial clearance gap 239 of about one meter is provided between the ring-wall 290 and the tower 214 to avoid interference as the tower 214 sways. Nested flex elements 218 are secured at a first end 236 to the bottom of a flex element sleeve 294 which serves as the base anchorage 244, and at the other end 238 to a tower anchorage 246 substantially the same as that described previously. Intermediate the two anchorages 244, 246 each flex element 218 is laterally restrained by a flex element base guide 254 and a lower flex element tower guide 256 in the manner described previously. This arrangement transmits lateral loads from the base 212 to tower 214 to restrain lateral and torsional movement of the tower lower end 226 without overstressing the flex elements 218.

Where it is impractical to use the flex piles 218 to restrain lateral and torsional motion of the tower 214, this function can be provided by the piles 296 used to rigidly secure the base 212 to the ocean floor 223. In this arrangement, the piles 296 would be grouted within the respective sleeves 292 only over the lower half of the sleeve height. Above this point the pile 296 would be left free to flex. The piles 296 would each extend upward a distance above the pile sleeves 292 into shear sleeves 298 secured to the tower 214. The upper end of each pile 296 would then act to restrain lateral and torsional movement of the tower lower end 226 in the same manner as the shear elements 68 of FIG. 8, described previously.

Fabrication of the piled base embodiment 210 of the compliant offshore structure is similar to fabrication of the gravity base embodiments. The lower portion of the tower 214 would be slipformed in the conventional manner in a graving dock. The ring-wall 290 would then be assembled in sections around the tower lower end 226. During the subsequent floating construction phases of the tower 214, the ring-wall 290 would hang suspended from the flex elements 218. The structure 210 would be substantially complete prior to installation. The only major operation remaining once the structure 210 is landed at the installation site is to drive the pin piles 296 through the pile sleeves 292 and then secure the piles 296 to the sleeves 294 to rigidly secure the base 212 to the ocean floor 223.

The preferred embodiment of the present invention and the preferred methods of using it have been detailed above. It should be understood that the foregoing description is illustrative, and that other embodiments of the invention can be employed without departing from the full scope of the invention as set forth in the appended claims.

What is claimed is:

1. A compliant offshore structure, comprising:

a base rigidly secured to the ocean floor;

a substantially vertical tower extending upward from said base, said tower having a bottom end portion, an upper end portion and a structure joining said bottom and upper end portions, said bottom end portion being substantially free from vertical load transmitting contact with said base, the longitudinal axis of said tower defining the central axis of said structure; and a plurality of elongate stabilizing members arranged in an array surrounding said central axis, each stabilizing member having a first end secured to said base and a second end secured to said tower at a stabilizing member anchorage located on said tower at a position above said base.

2. The compliant offshore structure as set forth in claim 1, wherein said structure further includes a deck, the combination of said deck and said tower having a net negative buoyancy.

3. The compliant offshore structure as set forth in claim 1, wherein each of said elongate stabilizing members is a nested tubular assembly.

4. The compliant offshore structure as set forth in claim 3 wherein said nested tubular assembly is a two element assembly, including an outer tubular element and an inner tubular element, each of said tubular elements having an upper end and a lower end, said upper ends being secured to one another, said inner tubular element lower end being secured to said base and said outer tubular element lower end being secured to said stabilizing member anchorage.

5. The compliant offshore structure as set forth in claim 3, wherein said stabilizing member anchorage circumferentially surrounds said tower wall element at a position proximate said tower bottom end portion.

6. The compliant offshore structure as set forth in claim 2, wherein said elongate stabilizing members support the full submerged weight of said deck and tower.

7. The compliant offshore structure as set forth in claim 6, wherein said tower is free from any load transmitting contact with said base.

8. A compliant offshore structure, comprising:

a base rigidly secured to the ocean bottom;

a substantially vertical tower extending upward from said base to a position above the ocean surface, the longitudinal axis of said tower defining the central axis of said structure;

a deck supported atop said tower, said tower and deck having a net negative buoyancy; and a plurality of vertically extending elongate flex elements arranged in an array surrounding the central axis of said structure, each of said flex elements having a first end secured to said base and a second end secured to said tower, said flex elements supporting the full operating weight of said tower and deck whereby said tower is free from direct vertical load transmitting contact with said base, said flex elements being adapted to provide said tower with a fundamental period in the range of between 25 seconds and 100 seconds, said flex elements being sized and positioned to respond elastically to tilting of said tower of at least about 1° in any direction from the vertical.

9. The compliant offshore structure as set forth in claim 8, wherein said structure is substantially free from lateral guyline support.

10. The compliant offshore structure as set forth in claim 8, wherein each flex element is a tubular member having a lower end secured to said base, and an upper end secured to said tower a spaced distance above said base.

11. The compliant offshore structure as set forth in claim 10, wherein each flex element is a nested elongate flex element.

12. A compliant offshore hydrocarbon drilling and production structure, comprising:

a base rigidly secured to the ocean floor;

a deck;

a substantially rigid, normally vertical tower supporting said deck above the ocean surface, said tower extending downward from said deck to a tower bottom end portion proximate said base, said deck and tower having a net negative buoyancy and being free from laterally extending guylines;

a plurality of elongate flex elements arranged in an array surrounding the longitudinal axis of said tower, each of said flex elements having a first end secured to said base and a second end secured to a flex element anchorage located on said tower at a position above said tower bottom end portion, said flex elements serving as the sole vertical load bearing structural connection between said tower and said base and further serving to maintain said tower bottom end portion a spaced distance above the underlying portion of said base, said flex elements being adapted to respond elastically to tilting of said tower up to at least about 1° in any direction from the vertical, whereby in response to pivoting of said tower away from a vertical orientation those flex elements positioned toward the direction of pivoting are placed in increased compression and those flex elements positioned away from the direction of pivoting are placed in decreased compression, whereby a moment is established at said flex element anchorage on said tower, this moment acting as a restoring force to bias said tower back to a vertical orientation.

13. A compliant offshore structure, comprising:

a gravity base on the ocean floor;

a substantially vertical concrete tower having a bottom end portion proximate said base, an upper end portion and a wall portion extending between said bottom and upper end portions;

a plurality of elongate flex elements, each having a first end secured to said gravity base at a gravity base anchorage and second end secured to said tower at a flex element anchorage secured to said tower, said flex elements extending upward from said base in an array exterior to said tower wall portion, said flex elements supporting said tower with said tower bottom end free from load transmitting contact with said base; and means for restraining relative lateral motion between said base and said tower bottom end portion, whereby said tower bottom end portion undergoes substantially no lateral motion in response to tilting of said tower.

14. The compliant offshore structure as set forth in claim 13, wherein said flex elements are nested tubular elements.

15. The compliant offshore structure as set forth in claim 13, wherein said flex elements are each a single tubular steel member.

16. The compliant offshore structure as set forth in claim 14, wherein said flex element anchorage is positioned and secured circumferentially surrounding the perimeter of said tower wall portion at a position on said tower wall portion proximate said tower bottom end portion.

17. The compliant offshore structure as set forth in claim 13, wherein said lateral motion restraining means includes a plurality of shear elements, each having one end secured to said base and a second end extending upward into a corresponding sleeve secured to said tower proximate said tower bottom end portion.

18. The compliant offshore structure as set forth in claim 13, wherein said lateral motion restraining means includes a plurality of sleeves secured to said tower bottom end portion, each of said sleeves receiving a corresponding one of said flex elements at a position below said flex element anchorage.

19. A method for constructing a compliant offshore structure having a base and a tower, said tower adapted to be supported free from vertical load bearing contact with said base in operation of said tower; said method comprising the steps of:

constructing said base, said base being provided with a construction support surface for said tower;

placing layer of sand on said construction support surface; constructing said tower atop said layer of sand;

securing flex elements between said base and said tower prior to washing said sand layer away from said construction support surface; and washing said sand layer away from said construction support surface to leave a gap intermediate said tower and said construction support surface on said base.

20. The method as set forth in claim 19, wherein said construction support surface is annular, said method further comprising the step of:

erecting a temporary vertical wall extending upward from the radially inner edge of said construction support surface.

* * * * *